United States Patent [19]

Card

[11] 4,127,192

[45] Nov. 28, 1978

[54] CORNER PAD

[75] Inventor: David R. Card, Memphis, Tenn.

[73] Assignee: Champion International Corporation, Stamford, Conn.

[21] Appl. No.: 857,096

[22] Filed: Dec. 5, 1977

[51] Int. Cl.[2] ..... B65D 85/30; B65D 85/48

[52] U.S. Cl. ..... 206/586; 206/521; 229/DIG. 1; 220/410

[58] Field of Search ..... 229/14 C, DIG. 1; 217/52; 206/320, 321, 323, 326, 586, 441, 521

[56] References Cited

U.S. PATENT DOCUMENTS

| | | | |
|---|---|---|---|
| 2,006,224 | 6/1935 | Weber et al. | 229/DIG. 1 |
| 2,271,265 | 1/1942 | Kirby | 217/52 X |
| 2,476,197 | 7/1949 | Kincaid | 220/410 |
| 2,509,468 | 5/1950 | Anderson, Jr. | 206/441 |
| 3,220,683 | 11/1965 | Doll | 206/586 |
| 3,655,112 | 4/1972 | Jeffers | 229/DIG. 1 |
| 3,900,156 | 8/1975 | Clark, Jr. | 206/441 |
| 4,000,843 | 1/1977 | Sorenson et al. | 206/586 |

*Primary Examiner*—Davis T. Moorhead
*Attorney, Agent, or Firm*—Evelyn M. Sommer

[57] ABSTRACT

A corner pad to absorb shock and prevent movement of a door frame or the like in a shipping carton. The pad is made from a unitary corrugated paperboard blank having a first and second rectangular panel provided with side flaps hingedly connected to opposite edges of each panel. The rectangular panels are hingedly connected to each other and folded into perpendicular planes relative to each other to define a corner opening to receive the frame. The side flaps on each panel are folded into parallel planes 90° to its respective rectangular panel, one of the side flaps connected to each rectangular panel overlapping and abutting one of the side flaps of the other panel. A corner of one of the two abutting side panels is folded over the other and locked to the other by tabs received in a cutout to rigidify the construction.

4 Claims, 6 Drawing Figures

CORNER PAD

BACKGROUND OF THE INVENTION

1. Field of the Invention

This invention relates to a corner pad and the blank therefore, used to protect aluminum door frames and the like during shipment.

2. Description of the Prior Art

Protective corner pads are commonly used to absorb shock due to rough handling of containers housing such breakable item as glass doors mounted in a door frame, windows mounted in a window frame, etc. The pads are disposed over the corners of the frame prior to packing of the frame within a receptacle or carton for shipment. Such pads preclude adjacent frames in the carton or receptacle from rubbing against each other, maintaining them spaced, and serve to preclude movement thereof within the shipping receptacle.

Prior art corner pads have not been totally satisfactory in use. The mode of assembly thereof has usually been complex. Further, such pads easily slip off the corner of the frame defeating its purpose. The pad construction of the present invention, however, overcomes these deficiencies.

SUMMARY OF THE INVENTION

In accordance with the present invention, a corner pad for a door frame or similar item is made from a one-piece corrugated paperboard blank. The blank is folded about score lines into a substantially triangular configuration having an opening for receiving the corner of a door frame or similar item.

The blank includes an upper panel hingedly connected to a lower panel which is scored at an angle along opposite corners thereof. The upper panel includes a first and second flap which are folded into parallel relation. Each flap includes a pair of substantially square cutouts. A flap on the lower panel is brought into abutting relation with each of the flaps of the upper panel. The scored corner of each of the lower flaps is then rotated about the outer edge of an upper flap to sandwich the upper flap between the abutting lower panel and corner panel. A pair of tabs are cut in the corner flap which overly the square cutouts in the upper flap. The square cutouts are pressed into the square cutouts to lock the corner panel and lower flap to the upper flap to retain the configuration of the corner pad intact. An elongated cutout is also provided in the lower flap so that pressure can be applied to the sandwiched upper flap to receive the locking tabs therethrough.

When the locking tabs are pressed into place to obtain the desired configuration of the corner pad, portions of the corner flap will lie above the plane of the upper flap. These upstanding portions of the corner flap will preclude substantial movement of the door frame disposed within the corner pad by presenting an obstruction to longitudinal movement of the frame. Therefore, the frame will be substantially locked in place in its shipping receptacle by the corner pad.

In addition, the flaps of the lower panel provide a smooth outer surface between which vertically stacked pads can rest on each other. Accordingly, there are no obstructions on which adjacent stacked frames need slide over, reducing and eliminating the potential problem of marring or scratching the door frames when they are removed from the shipping receptacle.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
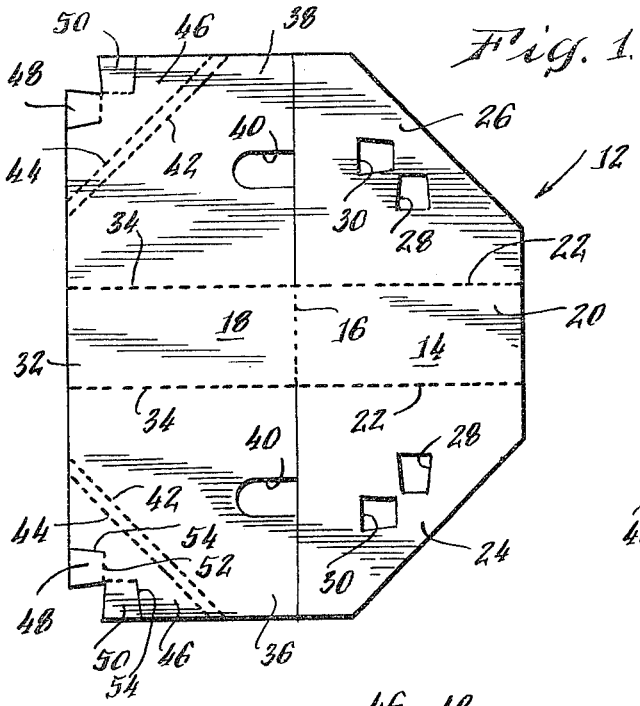
FIG. 1 is a top plan view of a blank used to form the corner pad of the present invention.

Referring now in detail to the drawing, wherein like numerals indicate like elements throughout the several views, the corner pad 10 of the present invention is formed from a unitary, planar, corrugated paperboard blank 12.

Blank 12 includes an upper panel 14 connected by a score line 16 to a lower panel generally designated by the numeral 18. Upper panel 14 includes a generally rectangular center portion 20 connected by a score line 22 to a side flap 24 and 26. The side flaps 24 and 26 are the mirror image of each other. A pair of substantially square cutouts 28 and 30 are provided in the center of each side flap 24 and 26.

Lower panel 18 includes a rectangular center portion 32 which is hingedly connected along score line 16 to center panel 20 of upper panel 14. Connected by score lines 34 to opposite sides of substantially rectangular center portion 32 of lower panel 18 are a pair of side panels 36 and 38. Panels 36 and 38 are substantially rectangular in shape and are the mirror image of each other. A cutout 40 extends from the top edge of each of the panels 36 and 38 towards the center of the panel.

The lower outer corners of each panel 36 and 38 include a pair of parallel, perforated lines 42 and 44 which extend from the lower edge of each panel to the outer side edge thereof. Lines 42 and 44 define a corner panel 46 on each side panel 36 and 38 of lower panel 18. A pair of tabs 48 and 50, which are complemental in shape and location to cutouts 30 and 28, respectively, on the side flaps 24 and 26 of upper panel 14 when lower panel 18 is folded over upper panel 14 about score line 16, are formed in the outer lower corner of the flaps 36 and 38 of lower panel 18. The tabs 48 and 50 are connected by a score line 52 to its respective corner panel 46 and the material of the corner panel is cut along a line 54 from an outer edge thereof to form the tabs.

Figure 2:
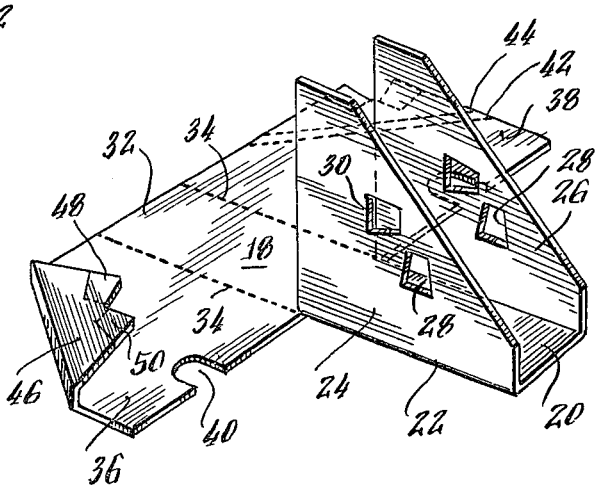
FIGS. 2 and 3 are perspective views illustrating the manner of folding the blank of FIG. 1 to form the corner pad of the present invention.
Figure 3:
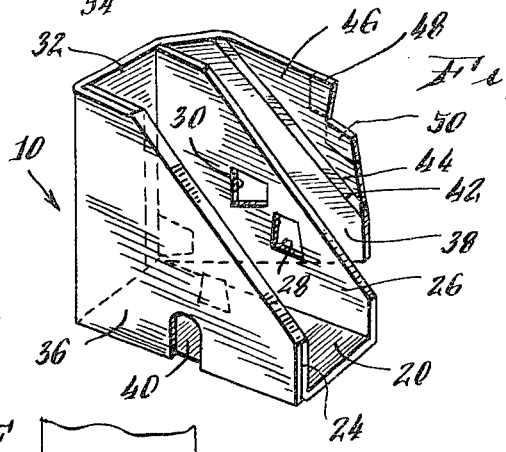
Figure 4:
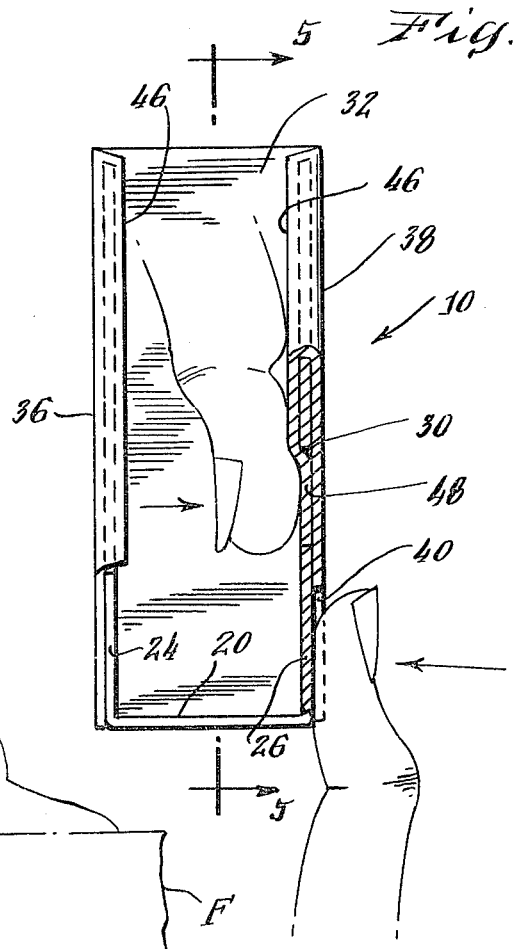
FIG. 4 is a front view in elevation, partly in section, of the assembled corner pad of the present invention.
Figure 5:
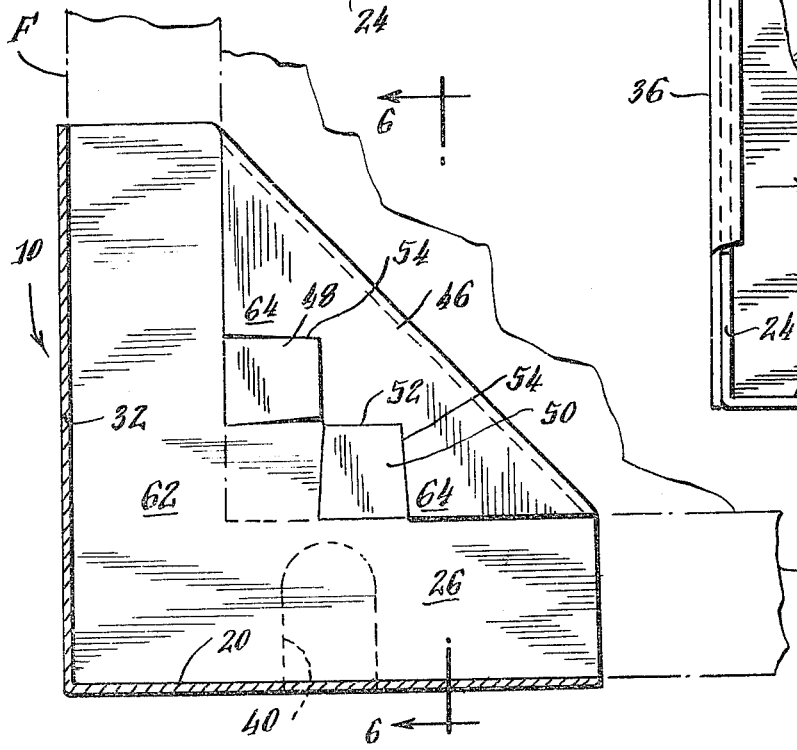
FIG. 5 is a cross-sectional view taken substantially along the plane indicated by line 5—5 of FIG. 4.
Figure 6:
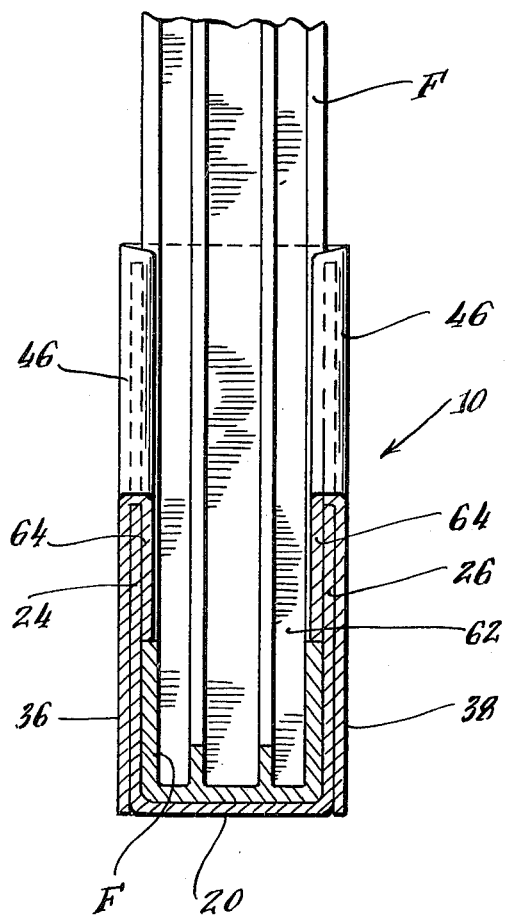
FIG. 6 is a cross-sectional view taken substantially along the plane indicated by line 6—6 of FIG. 5.

As shown in FIGS. 2 and 3, the corner pad 10 is assembled by first folding the side flaps 24 and 26 to a position lying in parallel planes 90° relative to center portion 20 by folding about score lines 22. Lower panel 18 is then folded into a plane substantially 90° of the plane of center portion 20 of upper panel 14 by folding lower panel about score line 16. Each of the side flaps 36 and 38 of the lower panel 18 are then folded about its respective score line 34 to a position wherein side panel 38 overlies and abuts upper side flap 24. Corner panels 46 are then rotated about perforated lines 42 and 44 so that they overlie the interior surface of side flaps 24 and 26 on the upper panel 14. The tabs 48 and 50 will be aligned with the cutouts 30 and 28, respectively, in each side flap. By applying pressure with the thumb to the sandwiched side flap 24 or 26 through the cutout 40 in the outer surface of the lower side panel 38 or 36, while pressing on each tab 48 and 50, the tabs can be inserted in the cutouts 28 and 30 to lock the lower panel to the upper panel and obtain a substantially triangular configuration, as shown in FIG. 5 of the assembled corner pad 10.

The resultant construction of corner pad 10 includes a smooth outer surface defined by the side panels 36 and 38 of the lower panel and an opening 62 to receive the corner of a door frame or similar item F. The corner of the frame F is slid over upstanding portions 64 of the corner panel 46 of pad 10 at the cut lines 54, which is formed by pressing the tabs 48 and 50 into the cutouts 30 and 28. These upstanding portions of the corner panels 46 preclude longitudinal movement of the frame within the pad as they serve as an obstruction or an abutment to such movement.

What is claimed as new is:

1. A corner pad construction for a door frame or the like comprising:

a central portion defining the rear of said pad construction including a first and second rectangular panel bent into planes substantially perpendicular to each other, a side flap hingedly connected to opposite edges of one of said panels and bent into substantially parallel planes to define with said panel an opening for receiving the corner of a door frame or like item, a side flap hingedly connected to opposite edges of the other of said panels bent into substantially parallel planes with respect to each other, each of the side flaps of said other panel overlying and abutting one of the side flaps hingedly connected to said one panel, each of said side flaps of said other panel including a cutout for applying pressure to said side flap of said one panel lying therebeneath while inserting said locking tab into said cutout, and each of said side flaps of said one panel including a pair of adjacent cutout portions, and said corner flap on each of said side flaps of said other panel including a pair of locking tabs complemental in shape and location to said cutout portions, and when said locking tabs are inserted in said cutout portions, said corner portion including an edge defining an upright obstruction to a door frame or the like inserted within said opening, and means on each of said side flaps connected to the other of said panels for securing each of said side flaps to one of said side flaps connected to said one panel, and means including a corner portion on each of said side flaps of said other panel defined by at least one angular line of weakness whereby said corner portion of said side flap can be folded over the abutting side flap of said one panel to sandwich the same between said side flap of said other panel and said portions, at least one cutout in said side flap of said one panel, and at least one locking tab on said corner portion insertable within said cutout.

2. The pad of claim 1 wherein said last named means includes at least one cutout in each of said side flaps of said one panel, and a locking tab on the abutting side flap of said other panel received in said cutout.

3. The pad of claim 1 wherein said corner portion on each of said side flaps of said other panel is defined by a pair of parallel, angular perforated lines.

4. A one-piece, planar, corrugated paperboard blank for forming the pad of claim 1.

* * * * *